United States Patent [19]

Wolf

[11] Patent Number: 4,459,446

[45] Date of Patent: Jul. 10, 1984

[54] CONTACT ARRANGEMENT FOR A SWITCH

[75] Inventor: Johann Wolf, Bubenreuth, Fed. Rep. of Germany

[73] Assignee: Siemens Aktiengesellschaft, Berlin and Munich, Fed. Rep. of Germany

[21] Appl. No.: 511,720

[22] Filed: Jul. 8, 1983

Related U.S. Application Data

[63] Continuation-in-part of Ser. No. 351,860, Feb. 24, 1982.

[30] Foreign Application Priority Data

Mar. 26, 1981 [DE] Fed. Rep. of Germany ..... 3112009

[51] Int. Cl.[3] ..... H01H 33/66

[52] U.S. Cl. ..... 200/144 B; 200/147 A

[58] Field of Search ..... 200/144 B, 147 A

[56] References Cited

U.S. PATENT DOCUMENTS

| | | | |
|---|---|---|---|
| 2,411,893 | 12/1946 | Peters | 200/147 A |
| 3,131,276 | 4/1964 | Watson | 200/144 B |
| 3,263,050 | 7/1966 | Pflanz | 200/144 B |
| 3,711,665 | 1/1973 | Dethlefsen | 200/144 B |

FOREIGN PATENT DOCUMENTS

| | | | |
|---|---|---|---|
| 1266130 | 5/1961 | France | 200/144 B |
| 46-16851 | 5/1971 | Japan | 200/144 B |
| 147768 | 11/1954 | Switzerland | 200/147 A |

*Primary Examiner*—Robert S. Macon

*Attorney, Agent, or Firm*—Karl F. Milde, Jr.; Andrew G. Rodau

[57] ABSTRACT

A configuration for a contact arrangement is disclosed for a switch having two coaxially positioned and generally cylindrical contacts. Each contact contains a coaxial core of ferromagnetic material, and a current-carrying envelope surrounding the core has the form of a helix. The helical envelope creates a current component which sets up a magnetic field in the widening contact gap when the contacts are separated that disperses arcing. Moreover, the field reinforces the closure pressure when the contacts are in their closed position. Ellipsoid shaping enables the field to be normal at all points of the contact-making surfaces.

12 Claims, 7 Drawing Figures

CONTACT ARRANGEMENT FOR A SWITCH

CROSS REFERENCE

This application is a continuation-in-part of my U.S. patent application, Ser. No. 351,860, entitled CONTACT ARRANGEMENT FOR A SWITCH, which was filed on Feb. 24, 1982.

BACKGROUND OF THE INVENTION

1. Field of the Invention

The invention relates to a contact arrangement for a switch, especially a vacuum switch or circuit breaker, having two coaxially positioned contacts.

2. Description of the Prior Art

It is known to prevent an increase in arc voltage and the associated high power transfer in switches by means of a coaxially magnetic field in the air gap between the opened contacts. For this purpose, a coil can be employed which cylindrically surrounds the switch housing, is arranged electrically in series with the switch contacts and which builds up a current-dependent axial magnetic field that permeates the gap between the contacts. In order to increase the field strength in the contact gap, the coil may be built up in a double layer with the windings running back and forth in helical fashion. The manufacture of such switches, however, entails a relatively high cost. An example of such an arrangement is disclosed in German Offenlegungsschrift DE-OS No. 29 11 706.

As shown by German Offenlegungsschrift DE-OS No. 25 46 376, contact arrangements for vacuum switches having planar contacts are known wherein the contacting surfaces of the contacts form circuit surfaces concentrically surrounded by a burn-off region. A planar cavity containing a ferromagnetic insert is positioned between each contact surface and the associated electrical connector lead. The plate-like insert is arranged radially of the arc to develop a radial current component having a force component which drives the arc radially outward toward the burn-off region of the contact.

Moreover, as disclosed in German Patent DE-PS No. 1 196 751, vacuum switches, are known which have cup-shaped contacts, the bases of which are connected to current leads and the rims of which present ring-shaped contacting surfaces. The annular walls of both contacts are configured with oppositely directed slanted slits which divide the walls into individual segments. These segments develop a current loop with the arc whose Lorenz forces cause the arc to be rotated between the contacts.

SUMMARY OF THE INVENTION

It is an object of the invention to provide a configuration for a contact arrangement having at least one generally cylindrical contact in which the arc current develops an axial magnetic field in the contact gap, that is concentric between the contacts and, moreover, that reinforces the closure pressure when the contacts are in their closed position.

In one aspect of the invention a contact arrangement for a switch of a type having two coaxially arranged and generally cylindrical contacts is provided, wherein at least one of the contacts contains a coaxial core of ferromagnetic material and wherein at least a portion of the current-carrying envelope part of the contact is in the form of a helix. In preferred embodiments of the invention described in greater detail below, both contacts are formed to have the same helical envelope configuration.

In one embodiment of the invention the contact arrangement for a switch having two contacts is provided, wherein one of the contacts is a generally cylindrical contact having a coaxial core of ferromagnetic material and a current carrying envelope surrounding the core, wherein at least a portion of the current carrying envelope is in the form of a helix, and a second contact is substantially flat.

In another embodiment of the invention the contact arrangement for a switch having two contacts is provided, wherein one of the contacts is a generally cylindrical contact having a coaxial core of ferromagnetic material and a current carrying envelope surrounding the core, wherein at least a portion of the current carrying envelope is in the form of a helix, and a second contact is substantially flat; both contacts having substantially flat contact surfaces which are substantially parallel to one another.

The helically wound envelope shape of the generally cylindrical contacts creates an azimuthal component of the current which to some extent acts like a coil which is relatively far removed from the contact. The ferromagnetic core serves to concentrate within the contact gap a magnetic field which expands radially outward from the contact axis. When the contacts are separated, the effect of the magnetic field in the widening gap causes a rapid reduction of the vapor pressure away from the center of contact.

There have thus been outlined rather broadly certain objects, features and advantages of the invention in order that the detailed description that follows may be better understood, and in order that the present contribution to the art may be better appreciated. There are, of course, additional features of the invention that will be described more fully hereinafter. Those skilled in the art will appreciate that the conception on which this disclosure is based may readily be utilized as a basis for the designing of other arrangements for carrying out the purposes of this invention. It is important, therefore, that this disclosure be regarded as including all such equivalent arrangements that encompass the spirit and scope of the invention.

BRIEF DESCRIPTION OF THE DRAWINGS

Embodiments of the invention have been chosen for the purposes of illustration and description, and are shown in the accompanying drawings forming a part of the specification, wherein.

Throughout the drawings, like elements are referred to by like numerals.

DESCRIPTION OF THE PREFERRED EMBODIMENTS

Figure 1:
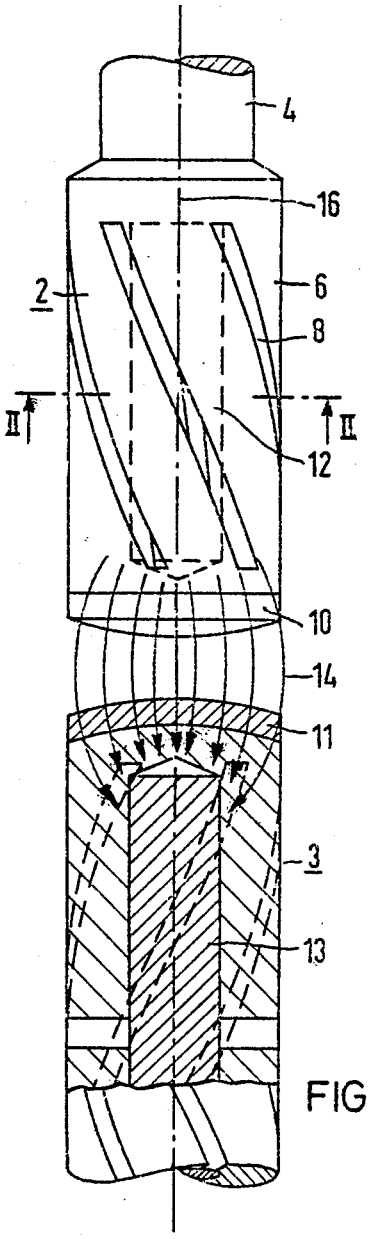
FIG. 1 is a side elevation view, shown schematically and partially in section, of a preferred embodiment of contact arrangement in accordance with the invention.
Figure 2:
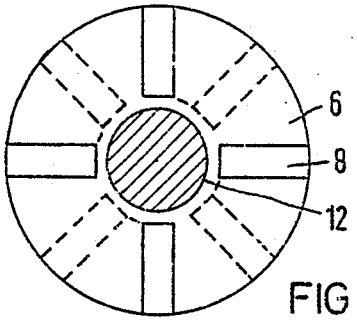
FIG. 2 is a section view taken along the line 2—2 of FIG. 1.

FIGS. 1 and 2 show an embodiment of a contact arrangement 1 for a vacuum switch in accordance with the invention. Two identical, generally cylindrical contacts 2 and 3 are positioned coaxially in opposing relationship. Each contact is connected to receive current from a supply lead 4. The envelope or jacket 6 of the contact 2 is formed with a plurality of helical grooves which impart a multi-grooved drill bit appearance to the envelope 6 and which end before the closed leading surface of the conductor. The leading surface of the contact 2 is covered by a contact overlay 10, preferably of a so-called "contact material" (arc-resistant material) such as chrome-copper.

The contact 3, shown in FIG. 1 positioned in opposing relationship to the contact 2, has a construction identical with that of the contact 3. The contact 2 is shown in FIG. 1 partially sectioned along a plane parallel to the page and the cylindrical axis of the contact 2. The helical grooves of contacts 2 and 3 run in the same direction. The contact 3 has an overlay 11.

The contacts 2 and 3 are respectively provided with ferromagnetic inserts 12 and 13. The inserts 12 and 13 are made of a soft magnetic material, such as iron, and run axially of the contacts 2 and 3. When current travels in the grooved envelopes of the contacts 2 and 3, the ferromagnetic inserts 12 and 13 develop a generally axially disposed field 14 in the contact gap between the contact overlays 10 and 11. The field 14 is concentrated along the cylindrical axis 16 of the contacts 2 and 3 and extends radially outward therefrom. Because 8f this field, there is rapid dispersion of the arc developed in the contact gap after the opening of the contacts 2 and 3, which limits power conversion. Moreover, this field concentration results in a relatively higher force for pressing together the closed contacts.

For the embodiment shown in FIGS. 1 and 2, the helical form of the parts of the envelope 6 is created by means of spiral grooves 8 which are cut into the contact envelope 6. The depth of the grooves 8 is less than the thickness of the envelope 6 so that the grooves do not extend to the core 12. Thus, the spiral shaping of the parts of the envelope 6 can be carried out in a vacuum up to the overlays 10, 11.

Figure 3:
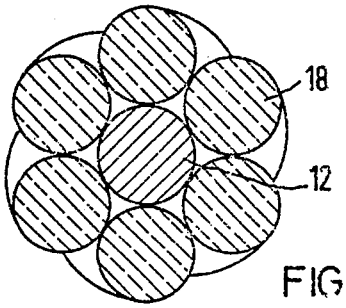
FIGS. 3–5 are section views, corresponding to the view of FIG. 2, of other forms of the embodiment of FIGS. 1 and 2.

FIG. 3 illustrates a modified embodiment of the invention wherein the envelope 6 of the contact 2 comprises a plurality of conducting rods 18 which are concentrically twisted in helical fashion about the ferromagnetic core 10. The twisted rods 18 may advantageously be electrically insulated from one another by means of insulating separation material or insulating coatings or sheaths (not shown).

Figure 4:
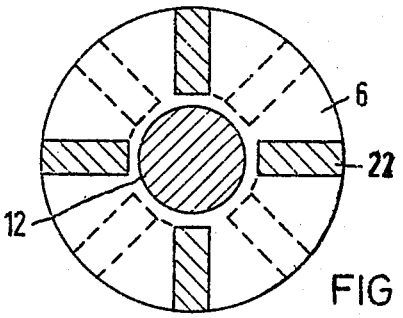

In another form of contact shown in FIG. 4, a plurality of helical inserts 22 made of electrically poorly conducting material, such as "contact material", are disposed concentrically about the core 12 within the envelope 6. The depth of the inserts 22 can advantageously be chosen to be less than the thickness of the envelope 6, so that the radial extent of the inserts 22 ends ahead of the core 12.

Figure 5:
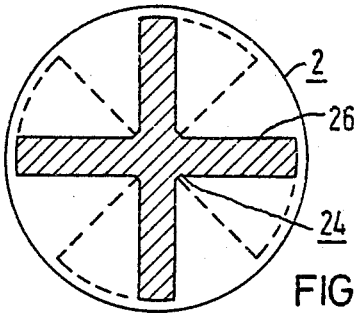

In yet another form of the invention shown in FIG. 5, the cylindrical shape of the ferromagnetic core 12 has been replaced by an elongated-shaped body member 24 which is positioned longitudinally of the axis of the contact 2. The body 24 is shaped with ribs or laminae 26 which run helically relative to the axis of the contact 2 to cause a generally spiral current to flow in the contact 2.

In order to efficiently concentrate the magnetic field within the contact gap, it is preferable to use a ferromagnetic core 12 which has small coercive force, such as iron. Through the action of the iron cores 12 and 13 in the two opposing contacts 2 and 3, a magnetic field developed by the spiraling current will be concentrated in the gap between the contact and expands radially outward from the contact axis. The contact-making surfaces of the contacts 2 and 3 can be advantageously configured, for example as ellipsoids, so that the magnetic field runs perpendicularly to the outer surfaces at all points of the outer surfaces which face each other in opposing relationship. As a practical consideration, the outer surface must be matched to the form of the magnetic field developed by the particular iron core. This gives the possibility to tailor the strength of the magnetic field to the mean current density. The use of an ellipsoid configuration of the contact-making surfaces makes possible the rapid reduction of vapor pressure from the center of contact as the gap between the contacts widens.

Figure 6:
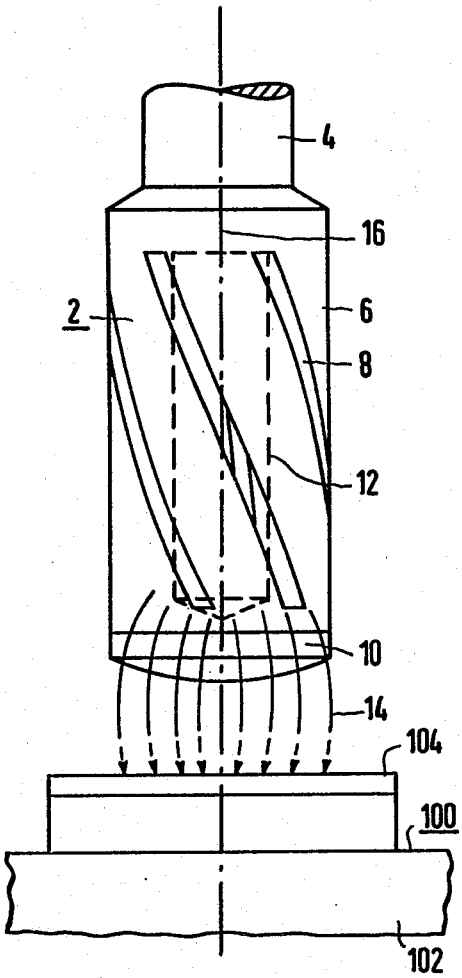
FIGS. 6 and 7 are side elevational views of alternate embodiments of the invention.
Figure 7:
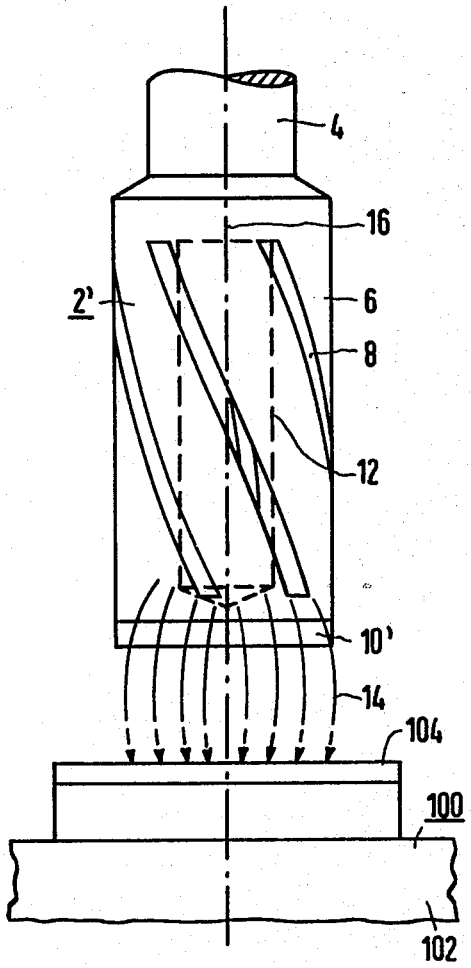

In other embodiment of the invention, shown in FIG. 6, the contact arrangement includes a first contact 2 as already described, and a second contact 100. Contact 100, as shown in FIGS. 6 and 7, is a substantially flat contact, which has been provided with a current supply (not shown) which generally includes a metallic conductive portion 102 of the contact housing. The leading surface of contact 100 is covered by a contact overlay 104. Overlay 104 is a so-called contact or arc-resistant material such as chrome-copper.

In another embodiment of the invention, shown in FIG. 7, the contact arrangement includes a substantially flat contact 100 as already described, and a generally cylindrical contact 2'. Cylindrical contact 2' is identical to previously described cylindrical contact 2 except for the shape of the contact overlay which can be a substantially flat overylay 10'.

It should be noted that the substantially flat contact overlay 10', shown in FIG. 7, can be utilized on any of the previously described contacts in place of the ellipsoid shape shown in FIG. 1.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto. It will be appreciated that the dimensions, shapes, materials and layout of the various elements of the described embodiment may be varied to suit individual tastes and requirements.

What is claimed is:

1. In a contact arrangement for a switch having two coaxially arranged and generally cylindrical contacts having respectively closed leading surfaces covered by contact overlays, the improvement comprising one of the contacts having a coaxial core of ferromagnetic material; and a current-carrying envelope surrounding the core, at least a portion of which is in the form of a helix.

2. An improvement as defined in claim 1, wherein the helix is defined by grooves whose depth is less than the radial thickness of the envelope.

3. An improvement as defined in claim 1, wherein the envelope comprises rods twisted in helical fashion.

4. An improvement as defined in claim 1, further comprising helical, electrically poorly conducting inserts located within the envelope.

5. An improvement as defined in any of claims 1–4, wherein the core comprises a shaped body provided with helical ribs running axially of the contact.

6. An improvement as defined in any of claims 1–4, wherein the core comprises a shaped body provided with helical laminae running axially of the contact.

7. An improvement as defined in any of claims 1–4, further comprising the other of the contacts having the same configuration as the one of the contacts, with the helixes of the two contacts running in the same direction.

8. A generally cylindrical contact having a closed leading surface covered by a contact overlay, for use in a switch having two coaxially arranged contacts, comprising an axial core of ferromagnetic material; and a current-carrying envelope surrounding the core, at least a portion of which is in the form of a helix, whereby a current flowing in the envelope will have a radial component for establishing a magnetic field which runs axially of the contact.

9. A contact as defined in claim 8, wherein the contact further comprises a leading contact-making surface having a generally ellipsoid shape, whereby the magnetic field set up by a current flowing in the envelope will be generally normal at all points of the contact-making surface.

10. A contact arrangement for a switch comprising two coaxially arranged generally cylindrical contacts, each of which has a coaxial core of ferromagnetic material and a current-carrying envelope surrounding the core, at least a portion of which is in the form of a helix; the helixes of the two contacts running in the same direction; whereby a current flowing in the envelopes of the two contacts will establish a magnetic field which runs axially of the contacts and reinforces the closure of the contacts when the switch is in its closed position.

11. An improvement as defined in claim 1, further comprising the other of the contact being a substantially flat contact, comprising a leading contact-making surface having a substantially flat shape.

12. An improvement as defined in claim 10, wherein both contacts have substantially flat contact surfaces, said flat contact surfaces being substantially parallel to one another.

* * * * *